US009242383B2

(12) United States Patent
Drai

(10) Patent No.: US 9,242,383 B2
(45) Date of Patent: Jan. 26, 2016

(54) MULTI FUNCTION HAND TOOL

(71) Applicant: Yehoshua Drai, Plantation, FL (US)

(72) Inventor: Yehoshua Drai, Plantation, FL (US)

( * ) Notice: Subject to any disclaimer, the term of this patent is extended or adjusted under 35 U.S.C. 154(b) by 272 days.

(21) Appl. No.: 14/036,540

(22) Filed: Sep. 25, 2013

(65) Prior Publication Data

US 2015/0082551 A1 Mar. 26, 2015

(51) Int. Cl.

| | |
|---|---|
| ***A62B 3/00*** | (2006.01) |
| ***B25F 1/04*** | (2006.01) |
| ***B26B 1/02*** | (2006.01) |
| ***B26B 1/04*** | (2006.01) |
| ***B26B 11/00*** | (2006.01) |

(52) U.S. Cl.
CPC ... *B26B 1/02* (2013.01); *B25F 1/04* (2013.01); *B26B 1/044* (2013.01); *B26B 11/00* (2013.01)

(58) Field of Classification Search
CPC ..... B25F 1/04; B26B 1/02; B26B 1/044; B26B 11/00; B26B 11/001; B26B 11/006; A62B 3/005
USPC ..... 7/118, 158
See application file for complete search history.

(56) References Cited

U.S. PATENT DOCUMENTS

| | | | | |
|---|---|---|---|---|
| 6,725,545 | B2 * | 4/2004 | Frank | 7/158 |
| D553,467 | S * | 10/2007 | Ryan | D8/99 |
| 8,707,490 | B1 * | 4/2014 | Pelton | 7/158 |
| D728,340 | S * | 5/2015 | Wang | D8/99 |
| 2006/0042098 | A1 * | 3/2006 | Morales | 30/298 |
| 2009/0313765 | A1 * | 12/2009 | Krudo | 7/158 |

* cited by examiner

*Primary Examiner* — Hadi Shakeri
(74) *Attorney, Agent, or Firm* — David W. Barman

(57) ABSTRACT

A multi function hand tool comprising:
a body;
an internal cavity having access on a first side of the body constructed within said body;
a second cavity accessed in a second side opposite said first cavity;
a cutting means fixedly placed within said second cavity and constructed in a manner to cut articles contacting said means within said second cavity;
a rotational tool having a first retracted position within said cavity and a second extended position outside said cavity;
a first contact tip formed on one end of said body; and
a second contact tip formed on said rotational tool, whereby each of said first contact tip and second contact tip impart a configuration for simultaneous contact and use when said rotational tool is in a retracted position.

8 Claims, 6 Drawing Sheets

MULTI FUNCTION HAND TOOL

BACKGROUND OF THE INVENTION

Multi function hand tools and knives are very widely used and popular. The well-known Swiss Army knife first went into use in 1891.

Tools with added utility are met with added difficulties, chief of which is the bulk of design.

One area that has not received attention are utility articles for rescuers and first responders. Although there are many advances in this field, these professionals still have tools and instruments that do not fulfill their needs. The present invention addresses this situation.

SUMMARY OF THE INVENTION

In one embodiment, the present invention is a multi function hand tool comprising:

a body;

an internal cavity having access on a first side of the body constructed within said body;

a second cavity accessed in a second side opposite said first cavity;

a cutting means fixedly placed within said second cavity and constructed in a manner to cut articles contacting said means within said second cavity;

a rotational tool having a first retracted position within said cavity and a second extended position outside said cavity;

a first contact tip formed on one end of said body; and a second contact tip formed on said rotational tool, whereby each of said first contact tip and second contact tip impart a configuration for simultaneous contact and use when said rotational tool is in a retracted position.

The tool has a utility cavity formed within a peripheral profile of said rotational tool. This configuration provides substantially all of the available perimeter being usable while providing a configured utility cavity.

In one embodiment, the utility cavity is formed to mate with a particular item external to said tool, for example, the utility cavity is constructed and arranged to mate with a valve of an emergency medical oxygen tank. This is not limited to tank opening and the present invention contemplates configuration of the utility cavity as desired.

In one embodiment, the rotational tool includes at least one surface having a plurality of grasping members or teeth.

In another embodiment, the rotational tool includes at least one sharpened edge, optionally; the edge terminates at a point.

In one embodiment, the rotational tool includes at least one fuller as is known in the art. The fuller imparts the advantage that a fullered blade can be 20% to 35% lighter than a non-fullered blade without any sacrifice of strength or blade integrity.

The tool includes a grasping orifice incorporated on the body on an end opposite the rotational tool, whereby said orifice in constructed and arranged to facilitate grasping and use of said tool.

The tool has a first tip and said second tip configured for use in applying blunt force.

The combination of the first tip and the second tip are configured for use in applying simultaneously applying blunt force when said rotational tool is in a retracted position.

DETAILED DESCRIPTION OF THE PREFERRED EMBODIMENT

Figure 1:
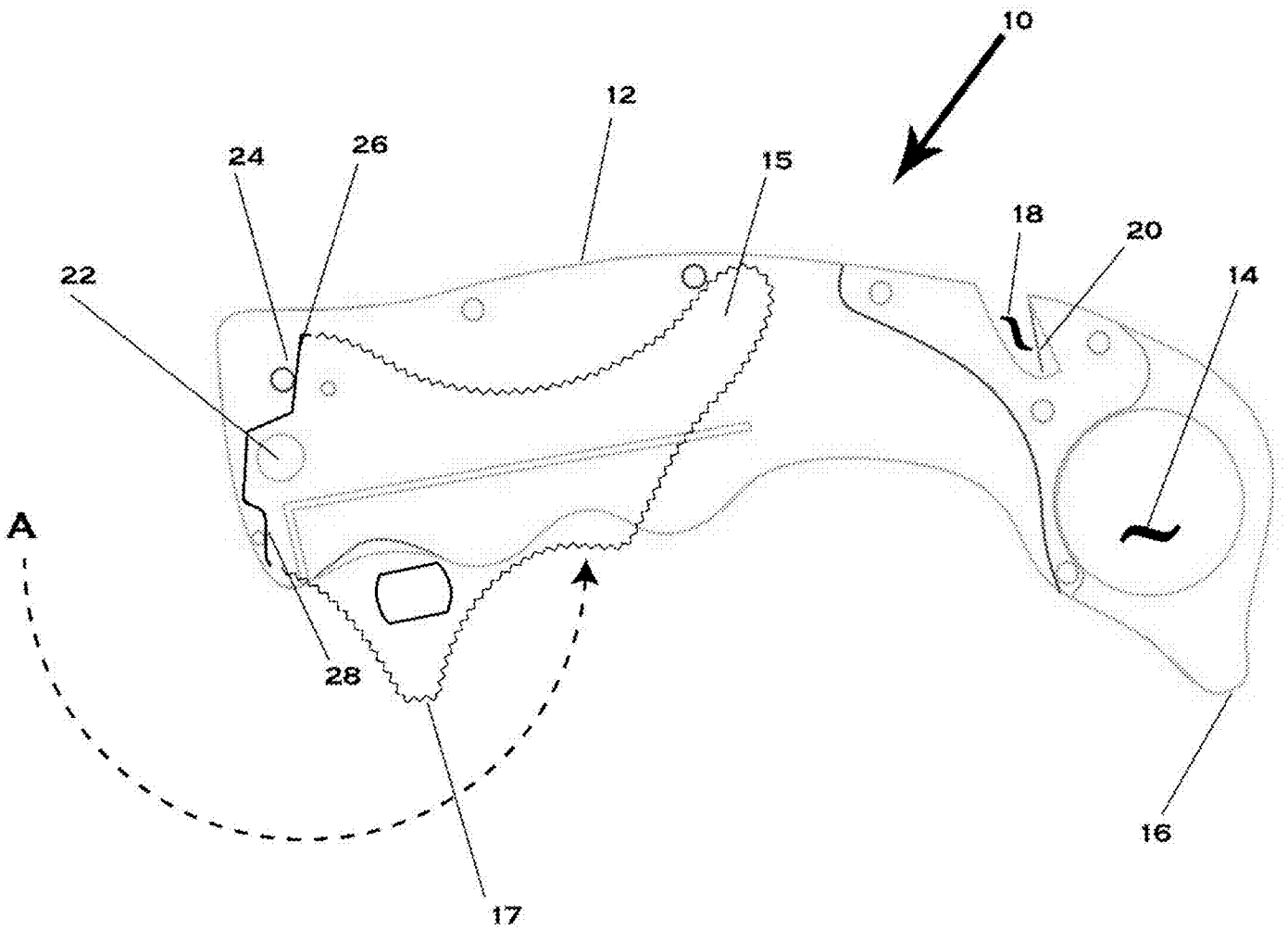
FIG. 1 is a plan view of one embodiment of the present invention with rotational tool retracted and arc A showing direction of retraction.

In one embodiment, the present invention is a multi function hand tool 10 having a main body 12 configured with an interior cavity formed with body cover 13 formed of joined plates 80 and 90 connected on top of main body 12 constructed and arranged to receive a rotational tool 15. In an arrangement where rotational tool is retracted into main body 12, a configuration is formed whereby a first tip 16 and second tip 17 are present in the same side of main body 12. In this configuration, the utilization of either or both first tip 16 and second tip 17 are constructed and arranged for battering or breaking. As one non-limiting example, a user strikes a glass pane with either or both of first tip 16 and second tip 17 in order to shatter the glass. This utility is contemplated as being used by rescue personnel who often only have larger instruments, such as an axe and the like, and the larger instrument poses a greater risk of harm to the person requiring rescue.

Main body 12 has incorporated therein an orifice 14 constructed and arranged to facilitate the grasping of tool 10 by insertion of a finger therethrough in order to use tool 10 with greater force. A blade cavity 18 is incorporated into body 12 whereby a blade 20 is positioned therein. Blade 20 is configured, in one embodiment, as a rescue blade formed to cut a seatbelt of other personal restraint during an extrication.

A first rotational tool 15 is incorporated with hand tool 10. In one embodiment, rotational tool 15 incorporates an edge with a plurality of grasping teeth and a utility cavity 46 constructed to interact with a plurality of devices. As one non-limiting example, utility cavity 46 assists with opening of oxygen tank valves. Tool 15 rotates about pivot 22. In one embodiment, retraction edge 26 contacts pin 24 to cease rotation of tool 15 about pivot 22. When rotated into an extended configuration, extension edge 28 contacts pin 24 and ceases rotation of tool 15.

Figure 2:
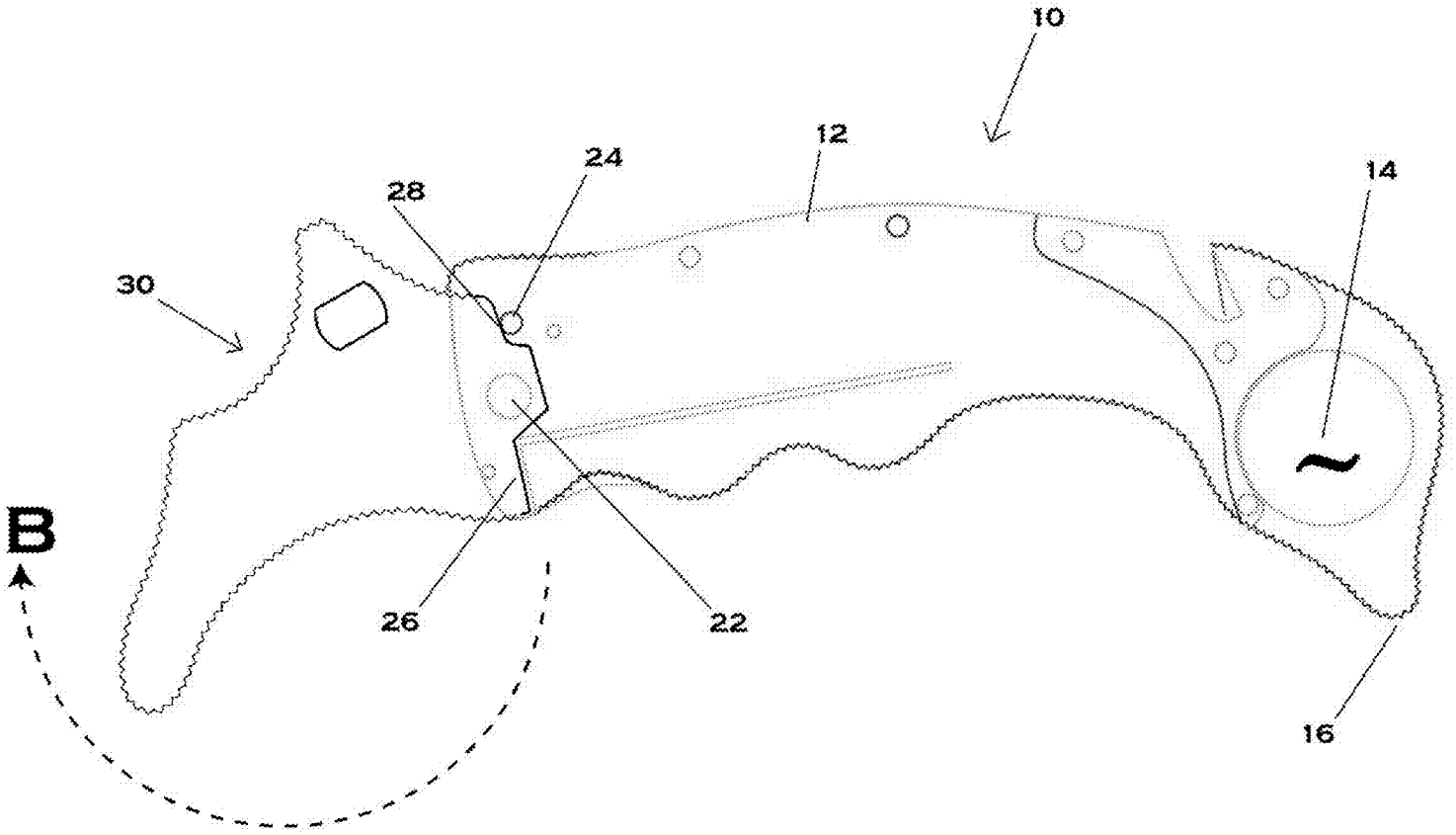
FIG. 2 is a plan view of one embodiment of the present invention with rotational tool extended and arc B showing direction of rotational extension.
Figure 3A:
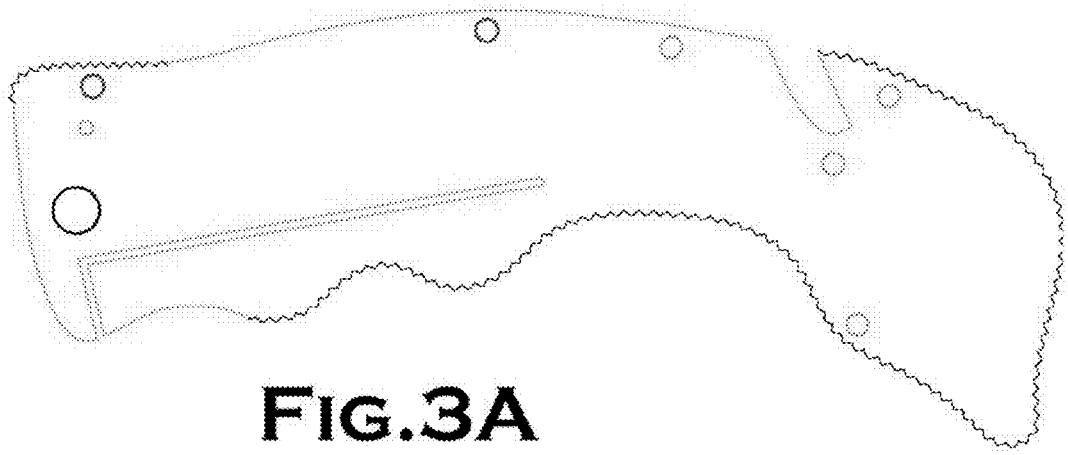
FIG. 3A is a plan view of one portion of the interior handle according to one embodiment of the present invention.
Figure 3B:
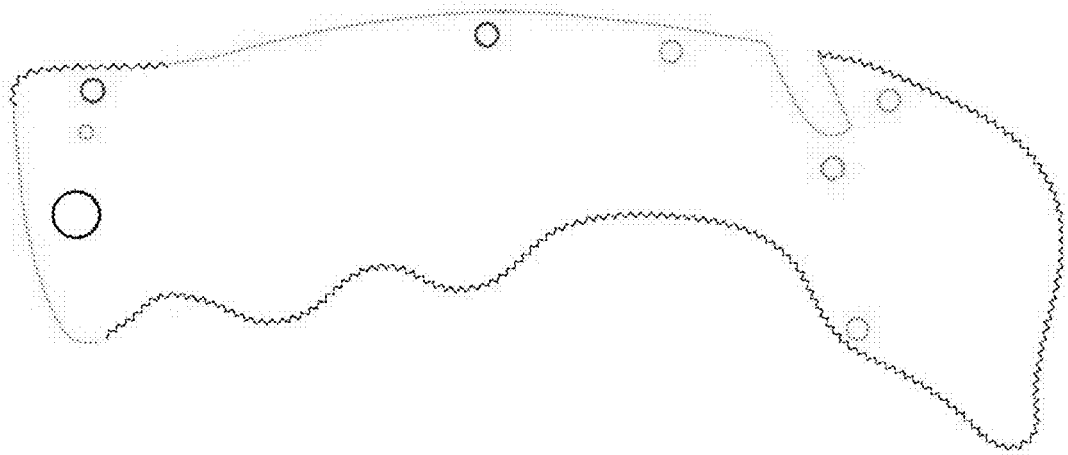
FIG. 3B is a plan view of the exterior handle according to one embodiment of the present invention.

In one embodiment, tool 10 is in a configuration as show in FIG. 2, whereby rotational tool 15 is extended and utilized as needed.

In either configuration of FIGS. 1 and 2, a user is always able to access cutting blade 20 in blade cavity 18.

Figure 4:
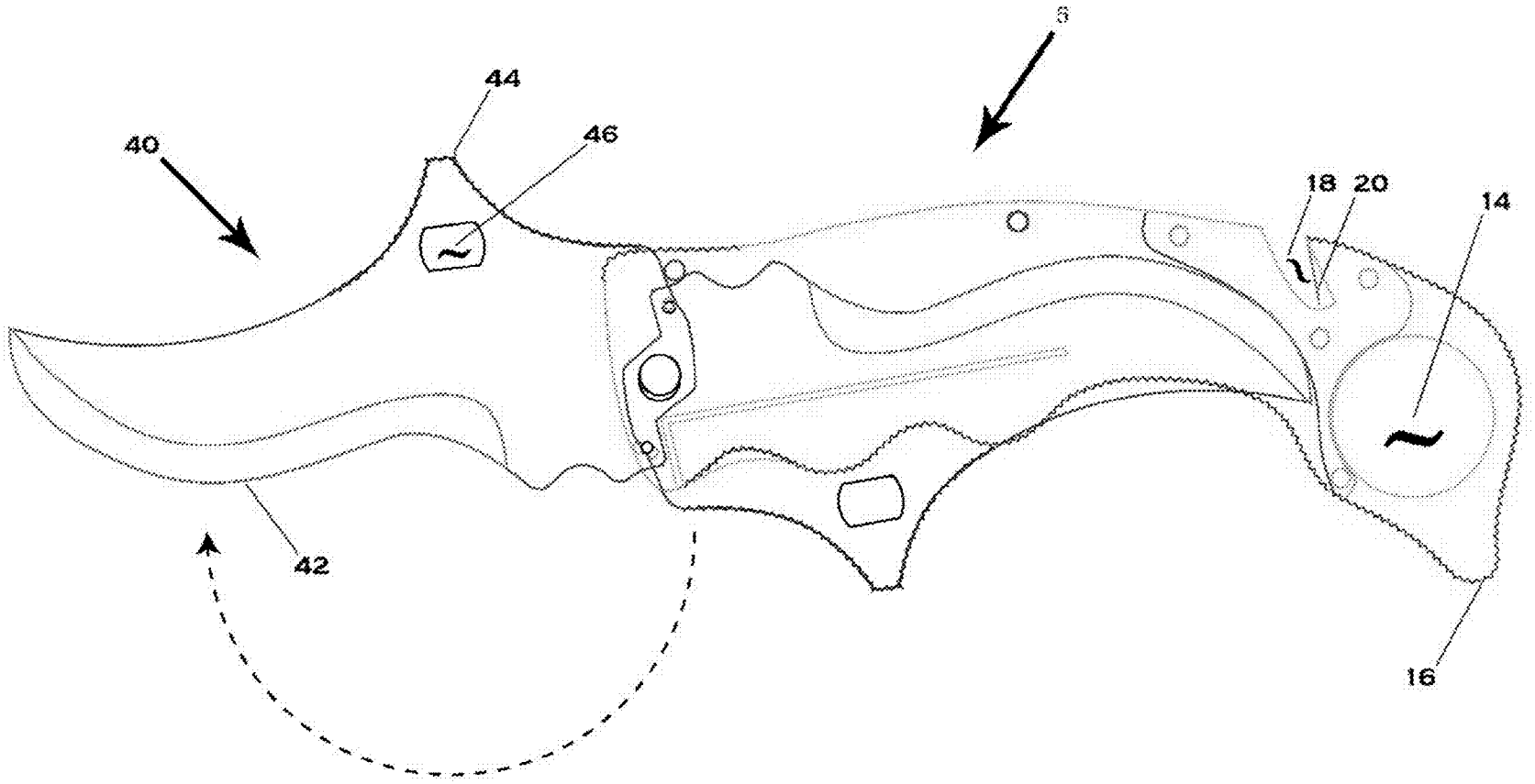
FIG. 4 is a plan view of one embodiment of the present invention with a rotational tool, presented as a knife, extended.

In the embodiment shown in FIG. 4, the rotational tool 5 as a rotational knife tool 40 uniquely configured with a tip 44 analogous to second tip 17 which, in a retracted position, along with first tip 16, are constructed and arranged for battering or breaking. As one non-limiting example, a user strikes a glass pane with either or both of first tip 16 and second tip 44 in order to shatter the glass. This utility is contemplated as being used by rescue personnel who often only have larger instruments, such as an axe and the like, and the larger instrument poses a greater risk of harm to the person requiring rescue.

Additionally, the knife tool 40 is uniquely configured with a utility cavity 46 incorporated within knife tool 40 to interact with a plurality of devices. As one non-limiting example, utility cavity 46 assists with opening of oxygen tank valves.

Figure 5:
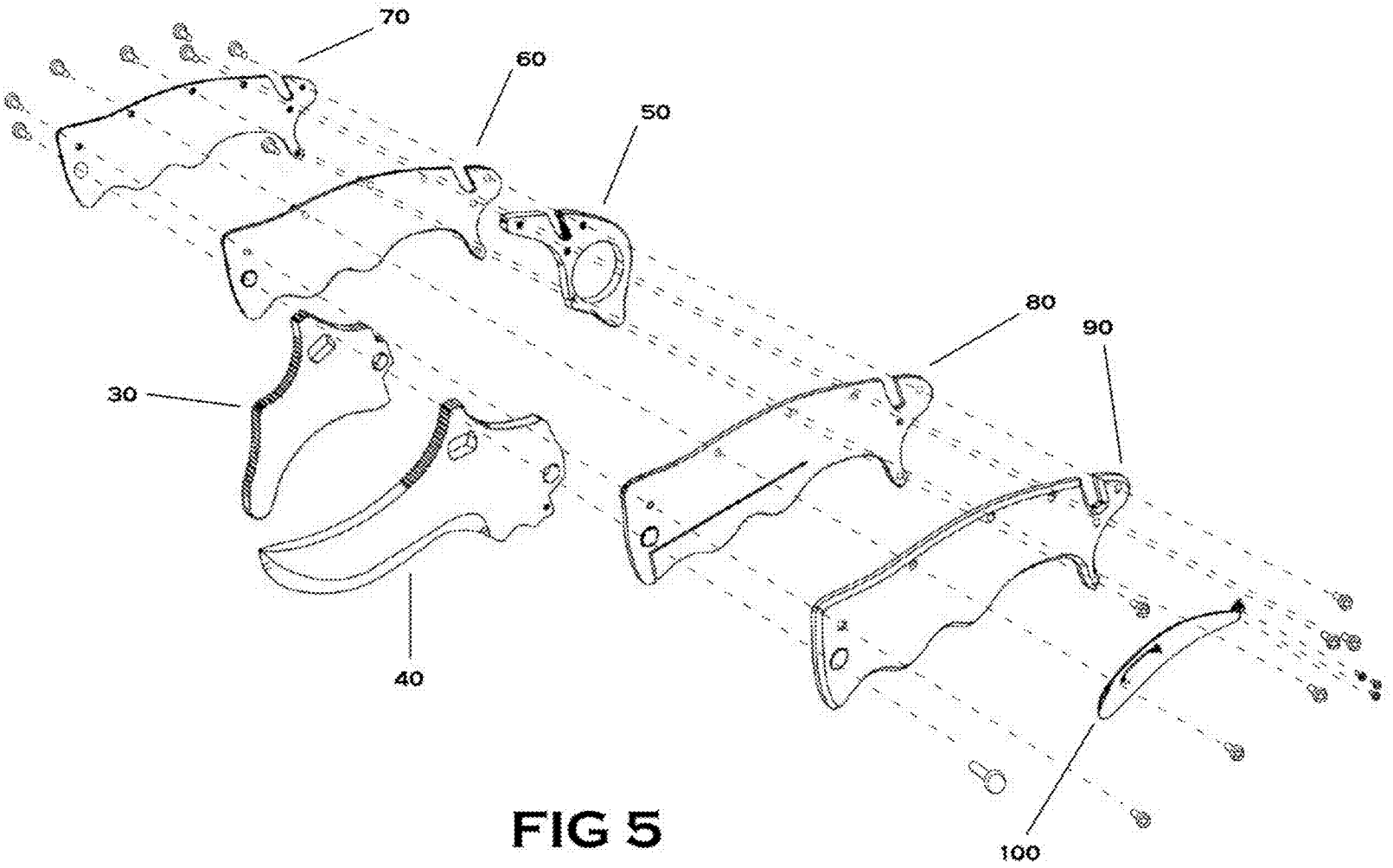
FIG. 5 is a perspective exploded view of the components of one embodiment of the preset invention.
Figure 6:
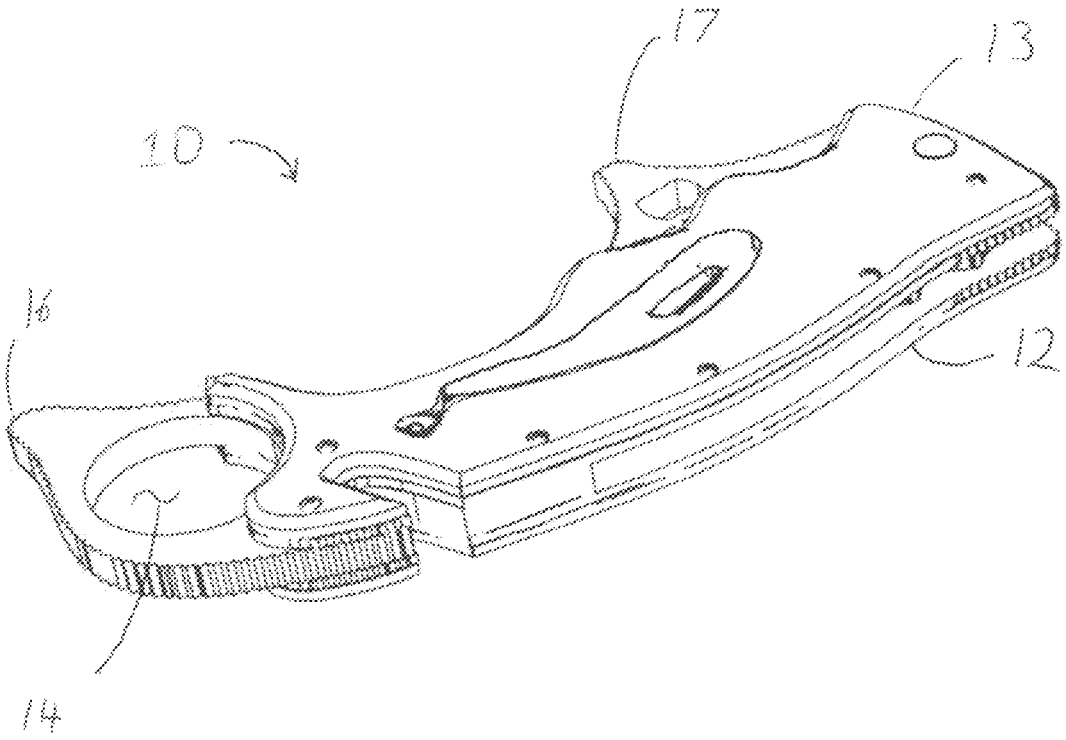
FIG. 6 is a plan view showing the closed configuration.

In one embodiment, as partially demonstrated in FIG. 5, body base 12 is separable into component parts being first end plate 70 second end plate 90 that respectively support first inner plate 60 and second inner plate 80. Fasteners, such as screws hold the component pieces together. In one embodiment, any one or more of the components of tool 10 are replaceable and interchangeable depending on need. In an assembled configuration a grasping portion 100 is incorporated thereon.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A multi function hand tool comprising:

a body;

an internal cavity having access on a first side of the body constructed within said body;

a second cavity accessed in a second side opposite said first cavity;

a cutting means fixedly placed within said second cavity and constructed in a manner to cut articles contacting said means within said second cavity;

a rotational tool having a first retracted position within said internal cavity and a second extended position outside said internal cavity;

an orifice incorporated on the body on an end opposite the rotational tool, whereby said orifice is constructed and arranged to facilitate grasping and use of said tool;

a first contact tip formed on said end of said body on said first side of the body;

and a second contact tip formed on said rotational tool, whereby each of said first contact tip and second contact tip impart a configuration for simultaneously applying a blunt force when said rotational tool is in a retracted position.

2. The tool of claim 1 further comprising a utility cavity formed within a peripheral profile of said rotational tool.

3. The tool of claim 2 wherein said utility cavity is formed to mate with a particular item external to said tool.

4. The tool of claim 3 wherein said utility cavity is constructed and arranged to mate with a valve of an emergency medical oxygen tank.

5. The tool of claim 1 wherein said rotational tool includes at least one surface with a plurality of grasping teeth.

6. The tool of claim 1 wherein said rotational tool includes at least one sharpened edge.

7. The tool of claim 6 wherein said edge terminates at a point.

8. The tool of claim 6 wherein said tool includes at least one fuller.

* * * * *